US007607901B2

(12) United States Patent
Williams et al.

(10) Patent No.: US 7,607,901 B2
(45) Date of Patent: Oct. 27, 2009

(54) WEAR RINGS FOR DOWNHOLE PUMP

(75) Inventors: Benny J. Williams, Godley, TX (US); Mark William Mahoney, Granbury, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 648 days.

(21) Appl. No.: 11/134,880

(22) Filed: May 23, 2005

(65) Prior Publication Data

US 2005/0265875 A1 Dec. 1, 2005

Related U.S. Application Data

(60) Provisional application No. 60/574,143, filed on May 25, 2004.

(51) Int. Cl.

| | |
|---|---|
| ***F16J 9/26*** | (2006.01) |
| ***F16J 1/04*** | (2006.01) |
| ***B23P 15/10*** | (2006.01) |
| ***F04B 39/10*** | (2006.01) |

(52) U.S. Cl. ..... 417/555.2; 277/440; 92/223; 29/888.048

(58) Field of Classification Search ..... 417/555.2, 417/554; 29/888.048; 92/222, 223; 277/440
See application file for complete search history.

(56) References Cited

U.S. PATENT DOCUMENTS

| | | | | |
|---|---|---|---|---|
| 818,636 | A | | 4/1906 | McEwen |
| 889,732 | A | | 6/1908 | Snyder et al. |
| 1,831,411 | A | * | 11/1931 | Dietz ..... 417/554 |
| 2,334,350 | A | | 11/1943 | Neuhaus |
| 2,415,984 | A | * | 2/1947 | Ballard ..... 277/451 |
| 2,560,775 | A | * | 7/1951 | Olsen ..... 277/460 |
| 3,168,052 | A | * | 2/1965 | Pate ..... 417/554 |
| 4,043,611 | A | | 8/1977 | Wallace |
| 4,103,748 | A | | 8/1978 | Arnold |
| 4,317,408 | A | | 3/1982 | Williams |
| 4,393,821 | A | | 7/1983 | Urano |
| 4,661,052 | A | | 4/1987 | Ruhle |
| 4,880,062 | A | | 11/1989 | Bland et al. |
| 5,284,084 | A | | 2/1994 | Pippert et al. |
| 5,469,777 | A | * | 11/1995 | Rao et al. ..... 92/223 |
| 5,992,525 | A | | 11/1999 | Williamson et al. |
| 6,092,593 | A | | 7/2000 | Williamson et al. |
| 6,145,590 | A | * | 11/2000 | Havard ..... 166/105.2 |
| 2002/0092647 | A1 | | 7/2002 | Terry |
| 2003/0155117 | A1 | | 8/2003 | Gray et al. |

* cited by examiner

*Primary Examiner*—Devon C Kramer
*Assistant Examiner*—Peter J Bertheaud
(74) *Attorney, Agent, or Firm*—Geoffrey A. Mantooth

(57) ABSTRACT

A downhole pump for a well has a barrel and a plunger. The barrel has a passage extending along the length of the barrel, with the passage having an inside diameter. The plunger has an outside diameter and is received by the barrel passage for relative reciprocal movement. One of the barrel or the plunger is equipped with wear rings, with a wear ring at one or at each end. The wear rings are made of a material that is harder than the material of the respective plunger or barrel. The wear rings provide protection from abrasion, particularly in a sandy well.

13 Claims, 5 Drawing Sheets

WEAR RINGS FOR DOWNHOLE PUMP

This application claims the benefit of U.S. patent application, Ser. No. 60/574,143, filed May 25, 2004.

FIELD OF THE INVENTION

The present invention relates to subsurface or downhole pumps such as are used to pump oil and other fluids in bases for oil wells.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. Subsurface, or downhole, pumps are located down in the well below the level of the oil. A string of sucker rods extends from the pump up to the surface to a pump jack device, or beam pump unit. A prime mover, such as a gasoline or diesel engine, or an electric motor, or a gas engine on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a chamber between the valves with fluid and then lifts the fluid up the tubing toward the surface.

The clearance between the plunger and barrel allows one to reciprocate easily and smoothly with respect to the other. This clearance is large enough to be lubricated by the downhole fluids and small enough to prevent leakage of fluid around the pump valves.

In normal use, the pump barrel and plunger experience wear. The wear leads to loss of performance of the lifting ability of the pump. Well fluid leaks around the traveling valve and the plunger; consequently the differential pressures across the valve that are necessary for its operation are unable to develop.

To repair the pump, the pump must be pulled from the well. The components are inspected and any worn components are replaced. Pulling the pump and replacing components results in downtime for the well and expense in the operation of the well. In normal use, a pump may last between three months to a year before it is pulled for repair.

In wells that produce sand, a pump may last only a few weeks. The sand abrades the ends of the reciprocating component and eventually enters the clearance between the plunger and the barrel, causing wear. Consequently, the pump components must be replaced more often.

Barrels and plungers are typically made of relatively soft material, having Rockwell hardness of C20. The barrels and plungers could be made of a harder material but they would be brittle and not as durable in the well. Instead, the barrels and plungers are treated on their wear surfaces so as to harden the wear surfaces. Such surface treatments include carbonizing, chroming and spray metal. Yet these treated surfaces quickly degrade in wells that produce sand.

SUMMARY OF THE INVENTION

It is an object of the present invention to provide an increase in the durability of pump components such as plungers and barrels.

A plunger is provided for use in a downhole pump. The plunger has an elongated body. At least portions of the body have an outside diameter that is structured and arranged to reciprocate relative to a barrel. The outside diameter has first and second ends. The outside diameter has a surface that has a first hardness. An inner passage runs through the body along the length thereof. Rings are located at the first and second ends, the rings made of a second material having a second hardness. The second hardness is greater than the first hardness.

In accordance with one aspect of the present invention, the rings have a hardness that exceeds Rockwell C70.

In accordance with another aspect of the present invention, the first and second ends each have a groove for receiving one of the rings.

In accordance with another aspect of the present invention, the rings have a first outside diameter and the plunger has a second outside diameter which is larger than the first outside diameter, the plunger second outside diameter structured and arranged to wear down to the first outside diameter.

The present invention also provides a barrel for use in a downhole pump. The barrel comprises an elongated body. A passage extends along the length of the barrel. At least portions of the body have an inside diameter around the passage, which passage is structured and arranged to receive a plunger. The inside diameter having first and second ends. The inside diameter has a surface that has a first hardness. Rings are located at the first and second ends. The rings are made of a second material having a second hardness. The second hardness is greater than the first hardness.

In accordance with one aspect of the present invention, the rings have a hardness that exceed Rockwell C70.

In accordance with another aspect of the present invention, the first and second ends each have a groove for receiving one of the rings.

In accordance with another aspect of the present invention, the rings have a first inside diameter and the barrel has a second inside diameter which is smaller than the first inside diameter, the barrel second inside diameter being structured and arranged to wear to the first inside diameter.

The present invention also provides a downhole pump having a barrel and a plunger. The barrel has a passage extending along the length of the barrel, with the passage having an inside diameter. The plunger has a plunger passage extending along the length of the plunger, with the plunger having an outside diameter. The plunger is received by the barrel passage for relative reciprocal movement. One of the barrel or the plunger has the respective diameter having a surface with a first hardness and having two ends. The ends have rings. The rings are made of a second material having a second hardness. The second hardness is greater than the first hardness.

In accordance with another aspect of the present invention, the one of the barrel or plunger is the shorter of the barrel or plunger.

In accordance with one aspect of the present invention, the rings have a hardness that exceed Rockwell C70.

In accordance with another aspect to the present invention, the downhole pump can be structured and arranged such that the barrel will reciprocate relative to the plunger.

In accordance with another aspect of the present invention, a clearance is located between the plunger and the barrel, which clearance provides a fluid seal. The rings are located at the ends of the clearance.

DESCRIPTION OF THE PREFERRED EMBODIMENTS

Figure 1:
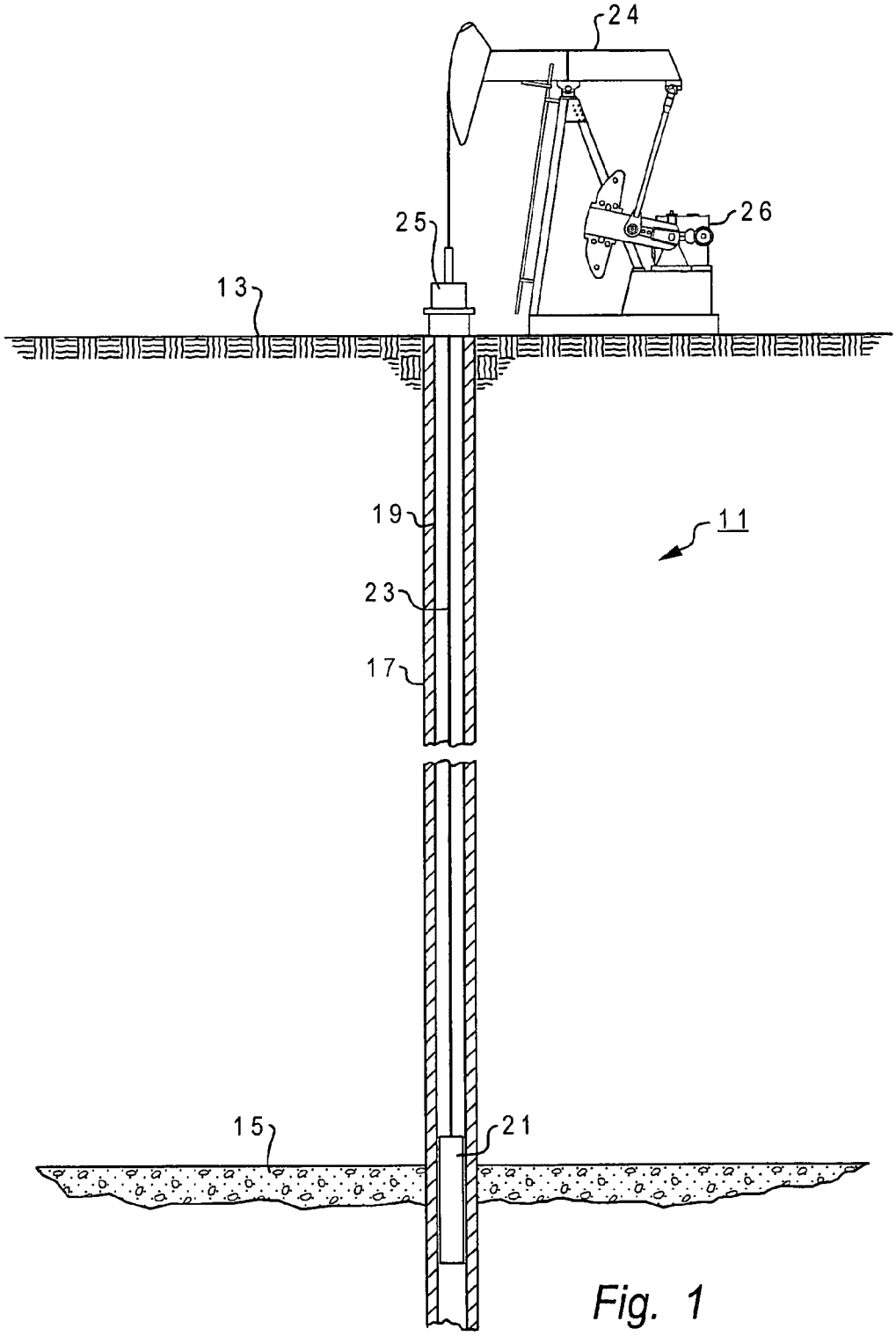
FIG. 1 is a schematic diagram of a well, shown with pumping equipment.

In FIG. 1, there is shown a schematic diagram of a producing oil well 11. The well has a borehole that extends from the surface 13 into the earth, past an oil-bearing formation 15. The borehole has been completed and therefore has casing 17 which is perforated at the formation 15. A packer or other method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod at a stuffing box 25 on the surface 13. The sucker rod string 23 is connected to a pump jack unit 24 which reciprocates up and down due to a prime mover 26, such as an electric motor, a gasoline or diesel engine, or a gas engine.

Figure 2:
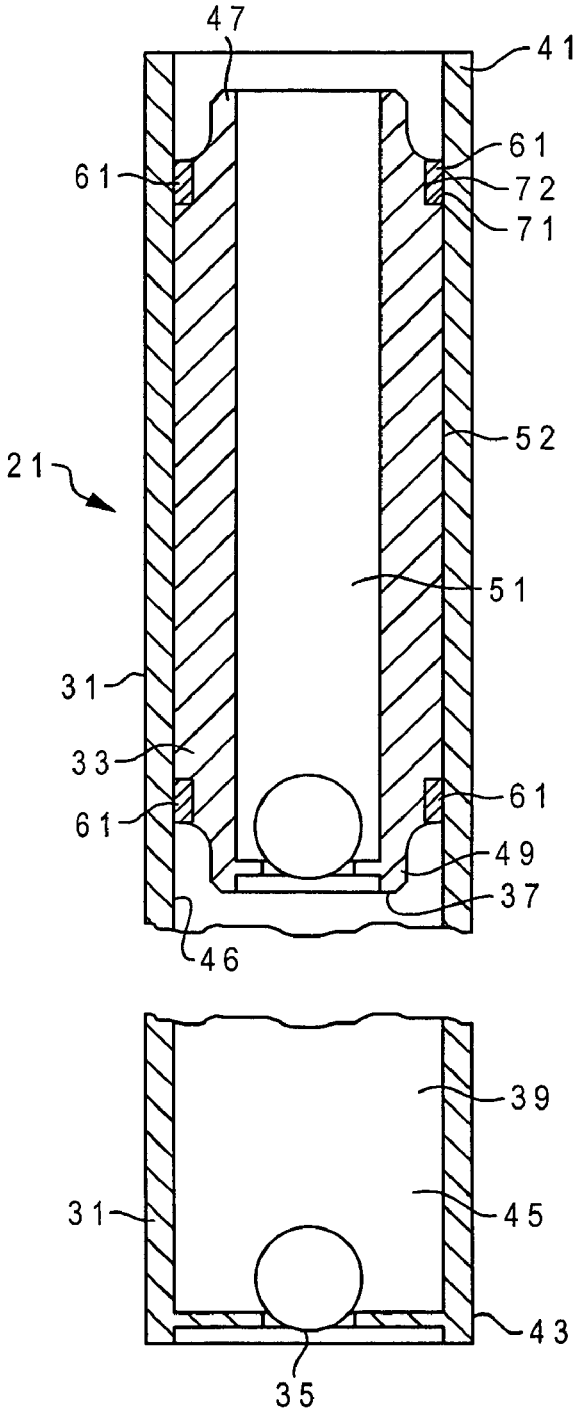
FIG. 2 is a longitudinal partial cross-sectional view of a downhole pump, in accordance with a preferred embodiment.

FIG. 2 schematically illustrates the downhole pump 21. The pump 21 has a barrel 31 and a plunger 33 that reciprocates inside of the barrel. The barrel 31 has a standing valve 35 and the plunger has a traveling valve 37 (the valves are schematic and are shown for illustration purposes). The pump 21 may have additional valves. The present invention may be used in a variety of pumps, such as insert type pumps and tubing type pumps. The invention can also be used on stationary barrel type pumps, regardless of whether the barrel is top anchored or bottom anchored. The invention can be used on traveling barrel type pumps as well.

The plunger 33 is reciprocated inside of the barrel by the sucker rods 23 (see FIG. 1). As the plunger is raised on the upstroke, fluid is drawn through the standing valve 35 into a barrel chamber 39; the traveling valve 37 is closed. As the plunger 33 descends on the downstroke, the standing valve 35 is closed and the fluid in the barrel chamber 39 is pushed through the traveling valve 37 into the plunger and the tubing above the plunger. This fluid is lifted on the next upstroke. The reciprocating movement of the plunger inside of the barrel is repeated to lift the fluid to the surface.

Ideally, the fluid contains only liquid, such as oil. However, there may be sand in the fluid. The sand tends to abrade and wear the barrel and plunger.

The barrel 31 is an elongated tube having two ends 41, 43 and a passage 45 that extends between the two ends. The passage 45, which receives the plunger 33, has an inside diameter 46. In the preferred embodiment, the inside diameter is constant throughout the length of the barrel. However, in some situations, the inside diameter may vary, particularly near one end, as described in U.S. Pat. No. 6,273,690.

The barrel is typically made in one length from one piece of material. However, the barrel can be made from segments that are joined together by threaded couplings.

The plunger 33 is elongated, having two ends 47, 49. The plunger 33 has a passage 51 extending between the ends. The bottom end 49 may receive the traveling valve 37, although the traveling valve may be at the upper end 47 or in the middle of the plunger.

Figure 4:
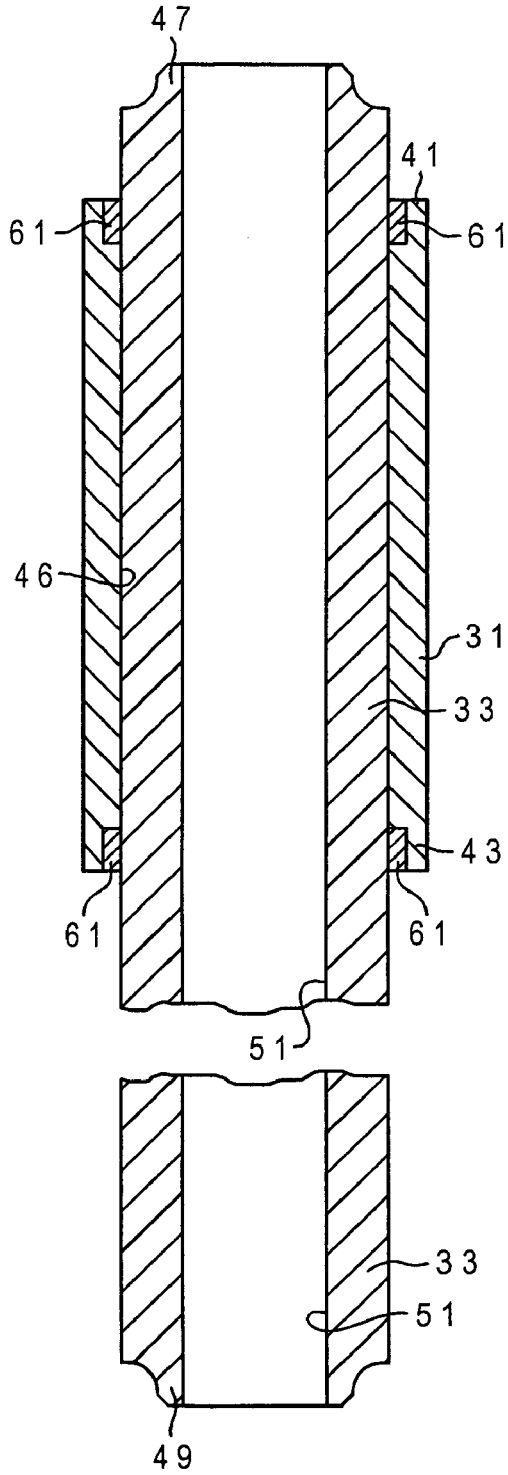
FIG. 4 is a longitudinal cross-section view of the pump, in accordance with another embodiment.
Figure 3:
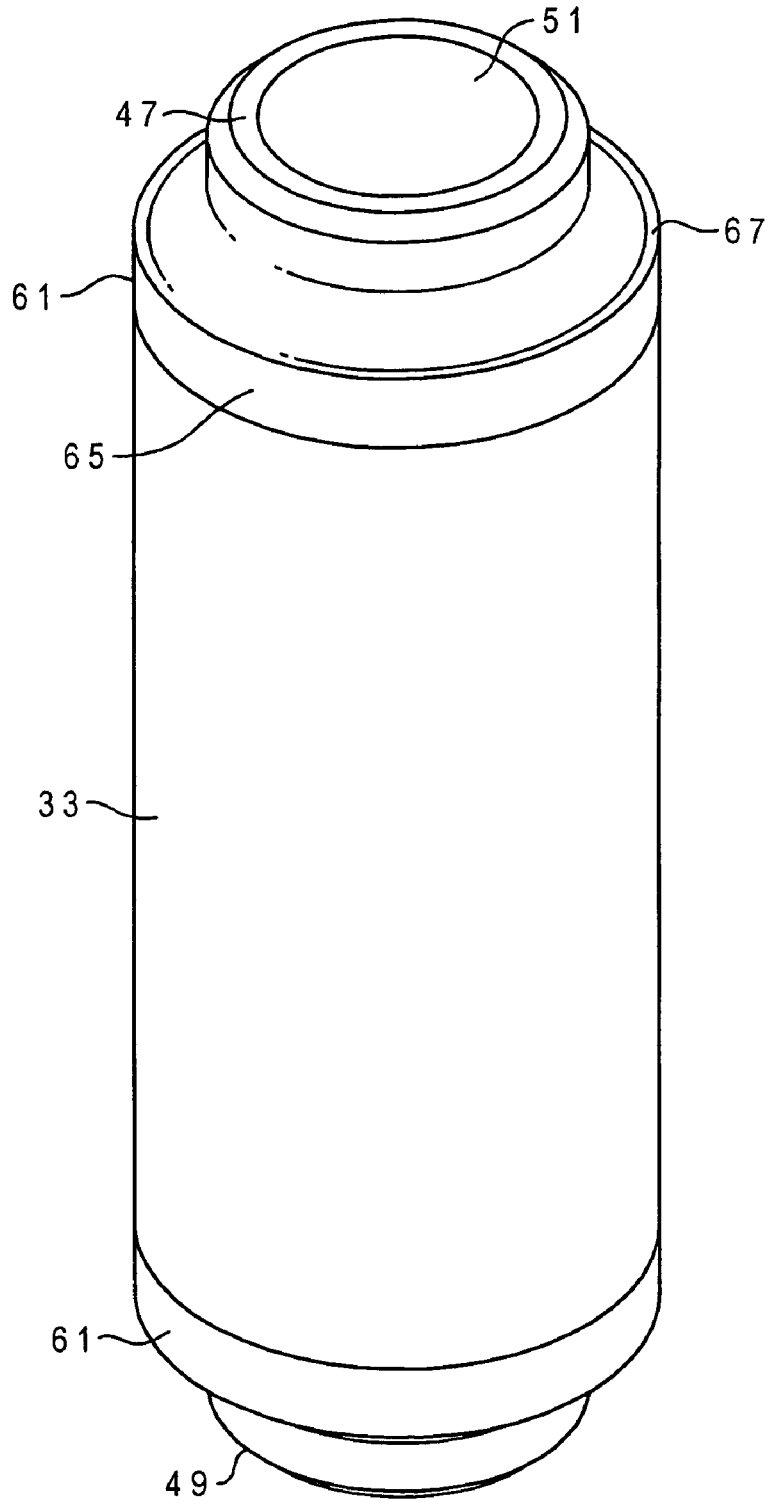
FIG. 3 is a view of the plunger of the pump of FIG. 2.

The ends of the plunger may be tapered, as shown. The plunger 33 has a segment between the ends, which segment has an outside diameter 52. In the preferred embodiment, the outside diameter is constant, although as described in U.S. Pat. No. 6,273,690, the outside diameter could vary. The outside diameter 52 of the plunger which provides a suitable working clearance is referred to herein as a "working" outside diameter. The working clearance is the spacing between the plunger and the barrel. Likewise, the inside diameter 46 of the barrel which provides a suitable working clearance is referred to herein as a "working" inside diameter. The outside diameter of the plunger is sized slightly smaller than the inside diameter of the barrel, to provide it with a typical working clearance 81 (see FIG. 6) of 0.002-0.005 inches. The size of the working clearance 81 varies depending on the viscosity of the fluid, the length of the plunger (in a pump such as shown in FIG. 2, or the length of the barrel in a pump such as shown in FIG. 4) and the hydrostatic pressure above the pump. A more viscous fluid will require a slightly larger clearance, while a higher hydrostatic pressure will require a smaller clearance or a longer clearance (such as a longer plunger in the pump of FIG. 2). The working clearance is sized so as to provide a seal between the plunger and the barrel, so that fluid will not leak through the clearance and also to allow some fluid in for lubrication between the reciprocating plunger and barrel.

The barrel 31 is made of a relatively soft material, having a hardness of around Rockwell C20. The barrels are typically made of brass (such as Admiral T, inhibited), steel, stainless steel or monel. The plunger 33 is typically made of steel, with a hardness of about Rockwell C20. The barrel 31 can be treated to increase the hardness and durability of the inside diameter surface. For example, the barrel can be furnace treated to carbonize the inside diameter. Likewise, the plunger 33 can be treated to raise its hardness of the wear surfaces, and in particular the outside diameter. Such treatments include chroming, spray metal, etc. The treated surfaces of the barrels and plungers have a hardness of about Rockwell C50-C70.

In the embodiment shown in FIG. 2, the plunger 33 is shorter than the barrel 31. The plunger 33 is provided with wear rings 61 to increase the durability and minimize the wear of the plunger and barrel due to reciprocation in sandy wells. A wear ring 61 is provided at or near each end of the working outside diameter, which in the preferred embodiment is near each end portion of the plunger 47, 49. The abrasion caused by sand is concentrated at the ends of the working outside diameter; therefore the ends of the working outside diameter are the desired locations for the wear rings 61. Alternatively, if sand is only located at one end of the plunger then only one end can be provided with a wear ring. In the preferred embodiment, two rings, one at each end, is preferred because lateral forces act on the pump components, causing wear at the ends in the absence of the rings 61.

Figure 5:
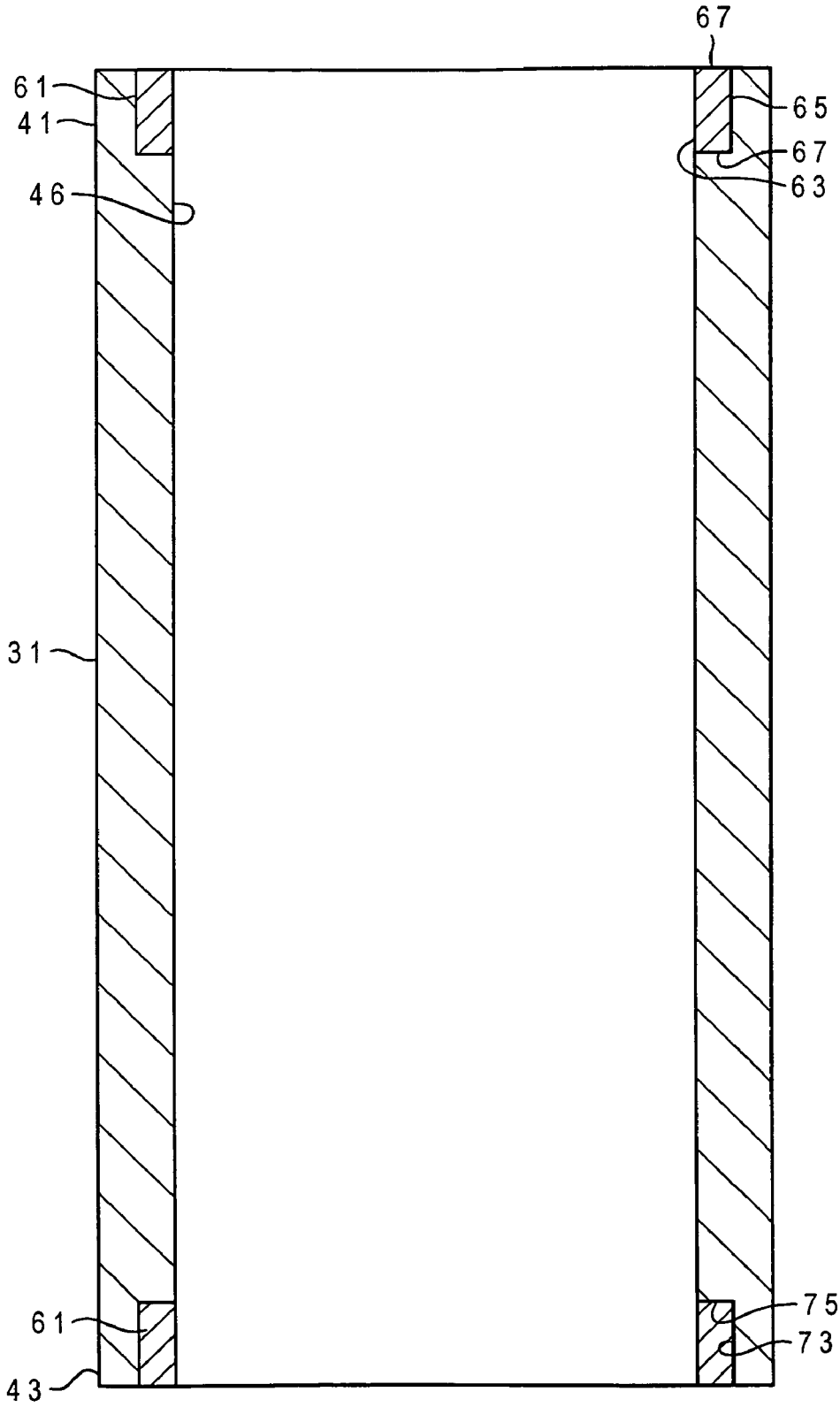
FIG. 5 is a longitudinal cross-sectional view of the barrel of the pump of FIG. 4.

In FIGS. 4 and 5, the barrel 31 is shorter than the plunger 33. Consequently, the barrel 31 is provided with wear rings 61, one wear ring at each end of the working inside diameter 46, which in the preferred embodiment is at one end 41, 43. Like the plunger, the wear rings are provided at the ends of the inside diameter 46 as this is where the abrasion by sand is concentrated. If the sand is only located at one end of the barrel, then a wear ring 61 need be provided only at that end.

Referring to FIG. 5, each wear ring 61 has an inside diameter 63 and an outside diameter 65. When the wear 61 rings are installed on the plunger 33, the outside diameter 65(see FIG. 6) is about the same as the working outside diameter 52 of the plunger. When the wear rings 61 are installed in the barrel 31, the inside diameter 63 (see FIG. 5) is about the same as the working inside diameter 46 of the barrel. The wear rings can be slightly smaller or larger in diameter than the associated working inside or outside diameters of the pump component.

In the preferred embodiment, the rings 61 in a barrel have a slightly larger inside diameter than the inside diameter of the barrel portion that is located between the rings. During reciprocation, the working inside diameter of the softer barrel will wear to the ring inside diameter. Likewise, the rings 61 on a plunger will have a slightly smaller outside diameter than the outside diameter of the plunger portion located between the rings. During reciprocation, the softer plunger portion between the rings will wear down to the ring outside diameter. By sizing the rings to provide for wear, any eccentricity of the rings are compensated for.

In addition, each wear ring 61 has opposite faces 67 or ends. The ring 61 has a length that is the distance between the faces 67. The ring has a depth or wall thickness that is the distance between the inside and outside diameters 63, 65. In the preferred embodiment, the wall thickness of a ring 61 is about ⅛ inches. The ring has a length-to-diameter ratio of about between 1:1 to 2:1. For example, on a 1½ inch outside diameter plunger, the rings 61 are each about 1½-3 inches in length. Providing a ring of such a length provides a satisfactory amount of wear surface, as well as provides stability and strength.

The wear rings 61 are made of a material that is harder than the treated surfaces of the plunger 33 or barrel 31. On the C scale of Rockwell hardness, 70 is the maximum. In the preferred embodiment, the wear rings are made of carbide and have a hardness of Rockwell A88, which is harder than C70. The hardness could be less than or greater than this value. The wear rings can be made of nickel carbide, titanium carbide, tungsten carbide, or other carbides. The wear rings could also be made of ceramic, such as silicon nitride, stabilized zirconium, alumina ceramic and so on. In addition, there are treated steels and heat-treated stainless steels that exhibit high hardnesses. It is also believed that beryllium copper would perform satisfactorily.

To install the wear rings 61 on a plunger 33 (see FIG. 2), a groove 72 is machined into each end of the plunger working outside diameter 52, which groove is open to the outside diameter of the plunger. The groove 72 creates a stop or shoulder surface 71. The wear ring 61 is installed into the groove 72 and secured in place. For a carbide or ceramic ring, the ring could be silver soldered or epoxyed in place. If the coefficient of thermal expansion is different between the rings and the barrel or the plunger, a shrink fit can be used. For example, the barrel can be shrink fit onto the wear rings.

To install wear rings on a barrel, a counterbore 73 (see FIG. 5) is machined into each end of the barrel, which counterbore is open to the inside diameter. The wear ring is inserted into the counterbore 73 so as to be against a stop surface 75 and secured in place by shrink fitting, soldering, epoxy, or some other method.

In operation, the wear rings 61 serve to greatly reduce the amount of wear in the clearance 81 between the plunger and barrel. For example, referring to FIG. 6, where the plunger 33 reciprocates in an upstroke, sand 83 contacts and accumulates on the upper end of the plunger working outside diameter 52.

Without the wear ring 61, the sand would, after numerous reciprocations, abrade or erode in the upper end of the working outside diameter of the plunger. The sand 83 would eventually enter the clearance 81 between the plunger and barrel, where the sand would increase the clearance. If the clearance becomes too large, fluid leaks around the plunger.

Figure 6:
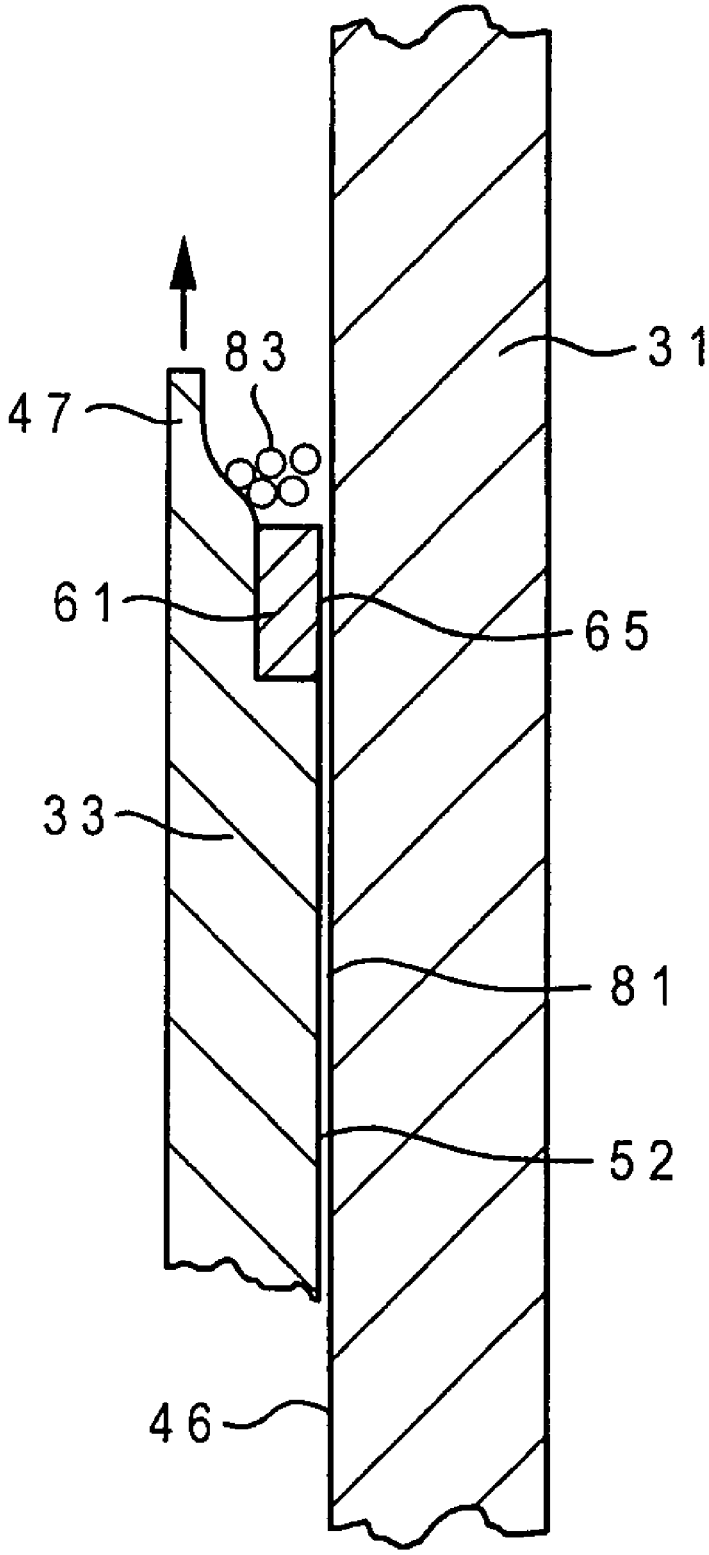
FIG. 6 is a detailed, cross-sectional view of the upper end portion of the plunger and the barrel, illustrating the wear ring.

With the wear ring 61 in place however, as shown in FIG. 6, the upper end of the working outside diameter of the plunger resists the destructive action of the sand. The sand is prevented from entering the clearance.

The wear ring at the bottom of the plunger operates in a similar manner, particularly on a downstroke of the plunger. As another example, referring to FIG. 4, on an upstroke of the plunger, sand will contact the bottom end of the barrel 43, while on the downstroke, sand will contact the top end 41 of the barrel. The wear rings 61 present a hard surface at the vulnerable ends to the sand, thereby reducing wear of those ends and preventing the sand from entering the clearance between the plunger and barrel.

The wear rings can also be used in a pump where the barrel moves relative to the plunger. For example, FIG. 2 illustrates such a pump. The valves are not in the locations shown however. The barrel valve (now the traveling valve) is at or near the top end of the barrel, while the plunger valve (now the standing valve) is at or near the top end of the plunger.

The wear rings will eventually wear, although after a significantly longer time. The component with the wear rings is replaced in the pump. For example, a plunger with wear rings is replaced by another plunger. The used plunger can be refitted by removing the worn wear rings and replacing with new wear rings.

The wear rings 61 maintain the clearance 81 and thus the seal of the pump in sandy environments. The pump will last longer, resulting in less downtime and pull time.

The foregoing disclosure and the showings made in the drawings are merely illustrative of the principles of this invention and are not to be interpreted in a limiting sense.

The invention claimed is:

1. A plunger for use in a downhole pump, comprising:

a) an elongated body;

b) at least portions of the body having an outside diameter that is structured and arranged to reciprocate relative to a barrel, the outside diameter having first and second ends, the outside diameter having a surface with a first hardness;

c) an inner passage through the body along the length thereof;

d) rings located at the first and second ends, the rings made of a second material having a second hardness, the second hardness being greater than the first hardness, the rings having an outside diameter, the ring outside diameter sized so as to produce a clearance with the barrel, the clearance providing a fluid seal;

e) the plunger having a second outside diameter which is larger than the ring outside diameter, the plunger second outside diameter being made of the same material as the plunger body, the plunger second outside diameter structured and arranged to wear down to the ring outside diameter.

2. The plunger of claim 1 wherein the rings have a hardness that exceeds Rockwell C70.

3. The plunger of claim 1 wherein the first and second ends each have a groove for receiving one of the rings.

4. The plunger of claim 1 wherein the rings are coupled to the plunger.

5. The plunger of claim 1 wherein the rings are made of carbide.

6. The plunger of claim 1 wherein the rings have a length to body outside diameter ratio of between 1:1 to 2:1.

7. A downhole pump, comprising:

a) a barrel having a passage extending along the length of the barrel, the passage having an inside diameter;

b) a plunger having a plunger passage extending along the length of the plunger, the plunger having an outside diameter, the plunger received by the barrel passage for relative reciprocal movement;

c) the plunger having two ends and the respective diameter has a surface with a first hardness, with the ends having rings, the rings made of a second material having a second hardness, the second hardness being greater than the first hardness;

d) a clearance located between the plunger and the barrel, the clearance providing a fluid seal between the plunger and the barrel, the rings located at ends of the clearance;

e) the plunger having a second outside diameter which is larger than the ring outside diameter, the plunger second outside diameter being made of the same material as the plunger body, the plunger second outside diameter structured and arranged to wear down to the ring outside diameter.

8. The pump of claim 7 wherein the one of the plunger or barrel is shorter than the other.

9. The pump of claim 7 wherein the rings have a hardness that exceed Rockwell C70.

10. The pump of claim 7 wherein the barrel moves relative to the plunger.

11. The pump of claim 7 wherein the rings are coupled to the plunger.

12. The pump of claim 7 wherein the rings are made of carbide.

13. The pump of claim 9 wherein the rings have a length to diameter ratio of between 1:1 to 2:1, wherein the diameter is of the surface with the first hardness.

* * * * *